US009605817B1

(12) United States Patent
Goldney

(10) Patent No.: US 9,605,817 B1
(45) Date of Patent: Mar. 28, 2017

(54) FOLDING ILLUMINATION STAND

(71) Applicant: Edward A. Goldney, Phoenix, AZ (US)

(72) Inventor: Edward A. Goldney, Phoenix, AZ (US)

( * ) Notice: Subject to any disclaimer, the term of this patent is extended or adjusted under 35 U.S.C. 154(b) by 151 days.

(21) Appl. No.: 14/614,301

(22) Filed: Feb. 4, 2015

(51) Int. Cl.

| | |
|---|---|
| ***F21S 6/00*** | (2006.01) |
| ***F21L 4/00*** | (2006.01) |
| ***F21V 17/16*** | (2006.01) |
| ***F21V 21/116*** | (2006.01) |
| ***F21L 4/04*** | (2006.01) |
| ***F21V 17/00*** | (2006.01) |
| *F21W 131/10* | (2006.01) |
| *F21W 131/40* | (2006.01) |
| *F21V 1/00* | (2006.01) |

(52) U.S. Cl.
CPC ..... *F21S 6/007* (2013.01); *F21L 4/045* (2013.01); *F21V 17/007* (2013.01); *F21V 17/162* (2013.01); *F21V 21/116* (2013.01); *F21L 15/06* (2013.01); *F21W 2131/10* (2013.01); *F21W 2131/40* (2013.01)

(58) Field of Classification Search
CPC .. F21S 6/002; F21S 6/005; F21S 6/007; F21L 4/04; F21L 4/045; F21L 15/00; F21L 15/06; F21V 17/007; F21V 17/162; F21V 21/116; F21V 21/13; F21V 21/145; F21V 21/22; F21V 33/002; F21V 33/0028; F21W 2131/10; F21W 2131/40
See application file for complete search history.

(56) References Cited

U.S. PATENT DOCUMENTS

| | | | | |
|---|---|---|---|---|
| 2,119,442 | A | 12/1936 | Robinson | |
| 2,853,597 | A * | 9/1958 | Hartman | F21S 6/002 362/311.14 |
| 2,883,064 | A | 4/1959 | McKenzie | |
| 3,725,696 | A | 4/1973 | Morton | |
| 4,094,257 | A | 6/1978 | Zaccaria | |
| 5,105,343 | A | 4/1992 | Wakimoto | |
| 5,823,100 | A | 10/1998 | Wienhold | |
| 6,179,436 | B1 | 1/2001 | Gitkind | |
| 6,210,015 | B1 | 4/2001 | Ross | |
| 6,257,153 | B1 | 7/2001 | Portugal | |
| 6,280,051 | B1 | 8/2001 | Wallach | |
| 6,488,393 | B1 | 12/2002 | Burnham | |
| 6,561,107 | B1 | 5/2003 | Wood | |
| 6,682,209 | B2 * | 1/2004 | Drake | F21L 2/00 362/131 |
| 6,709,134 | B2 * | 3/2004 | Wu | F21V 1/00 362/311.01 |

(Continued)

*Primary Examiner* — Alan Cariaso
(74) *Attorney, Agent, or Firm* — Patent Law & Venture Group; Gene Scott

(57) ABSTRACT

A folding illumination stand having a pair of flat wire discs connected by two linear wire legs at rotational joints and by a further wire leg with one end removably joined so that the stand is foldable into a generally flat configuration. A vertically oriented flashlight is forced against an underside of an upper one of the discs by a spring mounted on a lower one of the discs. The flashlight's beam is directed vertically up through the upper disc and into a translucent container rested on the upper disk. This causes the container to glow, emitting a diffuse ambient illumination.

8 Claims, 5 Drawing Sheets

(56) References Cited

U.S. PATENT DOCUMENTS

| | | | | |
|---|---|---|---|---|
| 7,264,382 | B2 * | 9/2007 | Yoshimori | B60P 3/18 362/352 |
| 7,665,404 | B2 | 2/2010 | Yeh | |
| 7,988,343 | B2 * | 8/2011 | Palmisano, Jr. | F21V 17/007 362/190 |
| 8,590,716 | B2 | 11/2013 | Behjat | |
| 2002/0043181 | A1 | 4/2002 | Gist | |
| 2003/0202340 | A1 | 10/2003 | Wu | |
| 2007/0108365 | A1 | 5/2007 | Opolka | |
| 2010/0157579 | A1 | 6/2010 | Kononuk | |
| 2011/0031200 | A1 | 2/2011 | Chen | |
| 2012/0275169 | A1 * | 11/2012 | Pei-Lin | F21V 17/007 362/352 |
| 2013/0201681 | A1 * | 8/2013 | Morton | F21V 5/04 362/235 |
| 2015/0233558 | A1 * | 8/2015 | Ticktin | F21V 21/22 362/404 |

* cited by examiner

FOLDING ILLUMINATION STAND

BACKGROUND

The disclosed subject matter relates to the field of illumination and apparatus for enabling illumination. In particular this disclosure relates to a folding illumination stand constructed of heavy gauge wire; a stand that may be folded flat for compact storage.

Folding wire A-frames and three-legged stands are known to be used as shelf supports. Wire cooling racks, collapsible racks, and portable shelf assemblies are known, as well as folding floral tables and personal tables of wire construction. Additionally, there are very many different types and sizes of lamps and light projecting devices known in the prior art especially flashlights. There are also battery operated electric lanterns, oil lamps and other types of portable area illumination devices for use both indoors and out-of-doors and in popular use, for instance: at camp sites, on hiking trails, rock climbing, boating, spelunking and in a range of other activities. In most outdoor activities flashlights and water bottles or jugs are carried. However, although hand-held flashlights are universally used it seems somewhat redundant to also carry a lantern for general illumination at a camp site or in a tent. What is needed is a simple way of converting the beam of a flashlight into a general purpose area illuminator. The presently described apparatus fulfills this need.

SUMMARY

Embodiments of the presently described and illustrated wire folding wire frame stand provide for securing a light projecting device such as a flashlight and for resting a translucent water bottle, jug or similar object in position for receiving the flashlight beam to produce lantern-like illumination. The following detailed description includes references to the accompanying illustrations which form a part of the detailed description. Example embodiments are described in enough detail to enable those skilled in the art to practice the present subject matter. However, once familiar with this disclosure it will be apparent to one of ordinary skill in the art that the present apparatus may be practiced without some of the presented specific details. In other instances, well-known methods, procedures and components may not be described in detail so as not to unnecessarily obscure aspects of the embodiments. The embodiments can be combined, other embodiments can be utilized or structural and logical changes can be made without departing from the scope of what is defined and claimed. The following detailed description is, therefore, not to be taken in a limiting sense, as the scope is defined by the appended claims and their equivalents which are to be understood in their broadest possible sense.

In this document, the terms "a" or "an" are used, as is common in patent documents, to include one or more than one. Furthermore, the term "or" is used to refer to a nonexclusive "or," such that "A or B" includes "A but not B," "B but not A," and "A and B," unless otherwise indicated.

BRIEF DESCRIPTION OF THE DRAWINGS

Embodiments of the described apparatus are illustrated by way of example in the figures of the accompanying drawing sheets, in which like references indicate the same or similar elements shown and in which.

DETAILED DESCRIPTION

Figure 1:
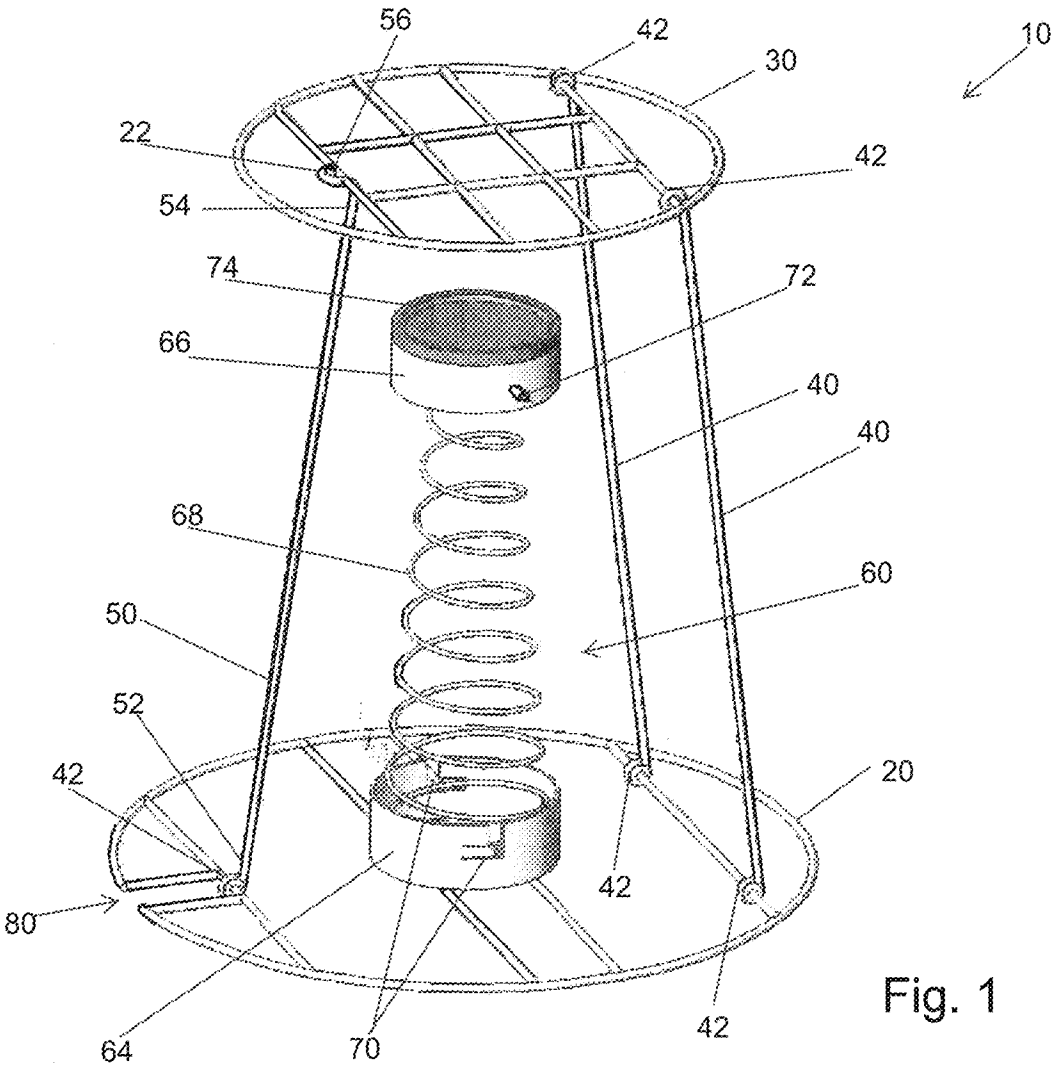
FIG. 1 is a perspective view of embodiments of a wire frame stand as erected.
Figure 2:
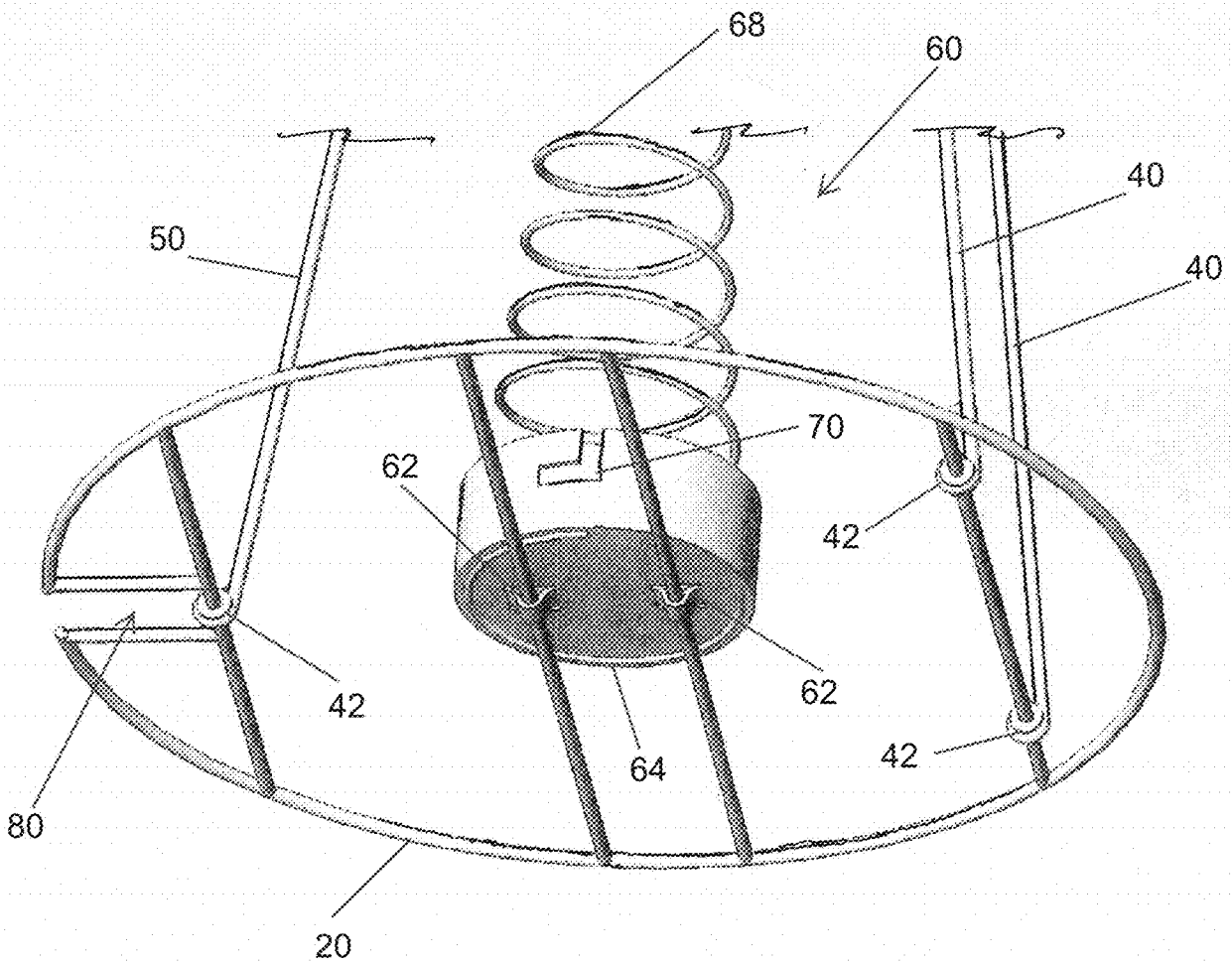
FIG. 2 is a partial bottom perspective view thereof.
Figure 3:
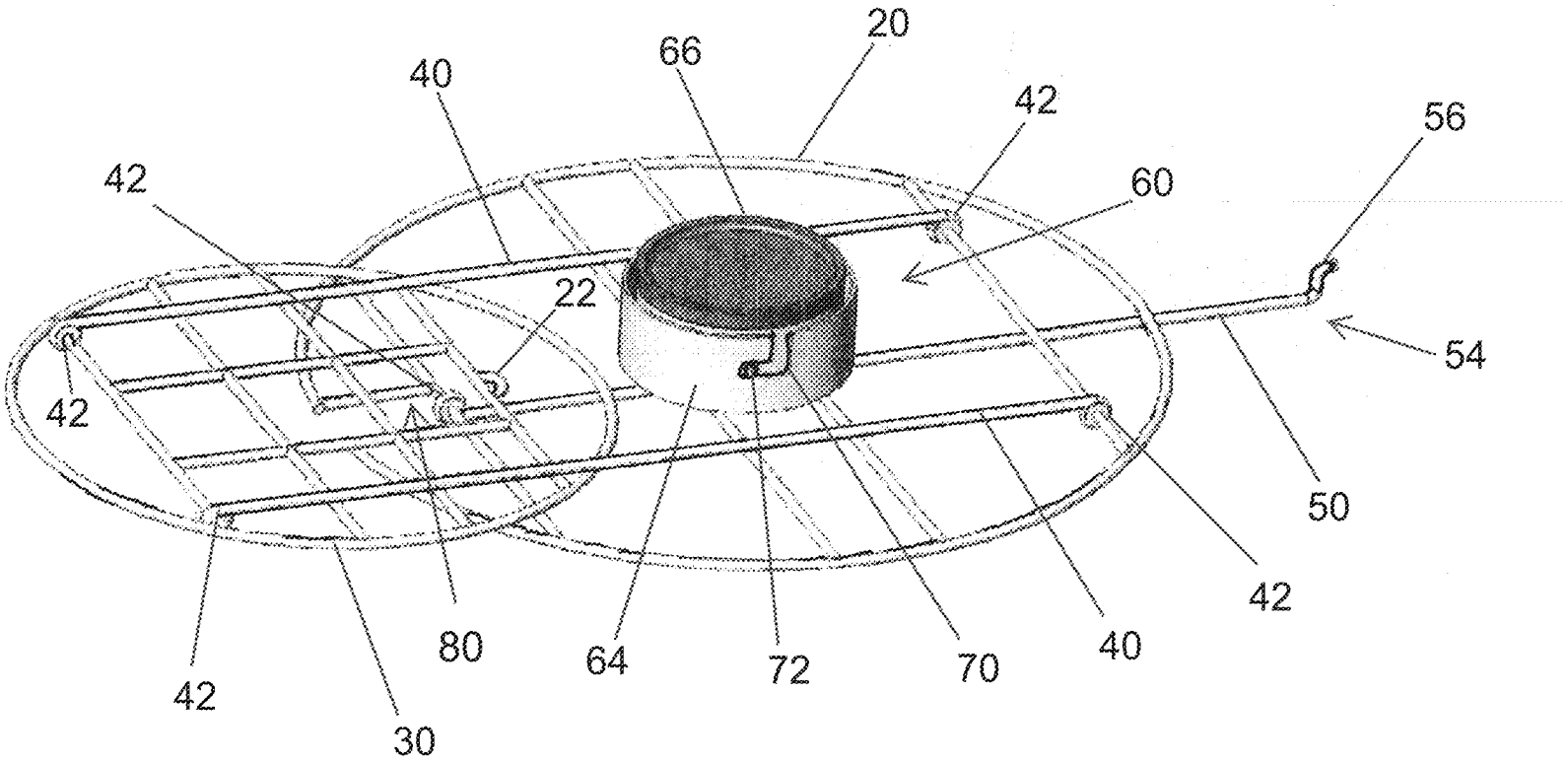
FIG. 3 is a; perspective view thereof as folded compactly.
Figure 4:
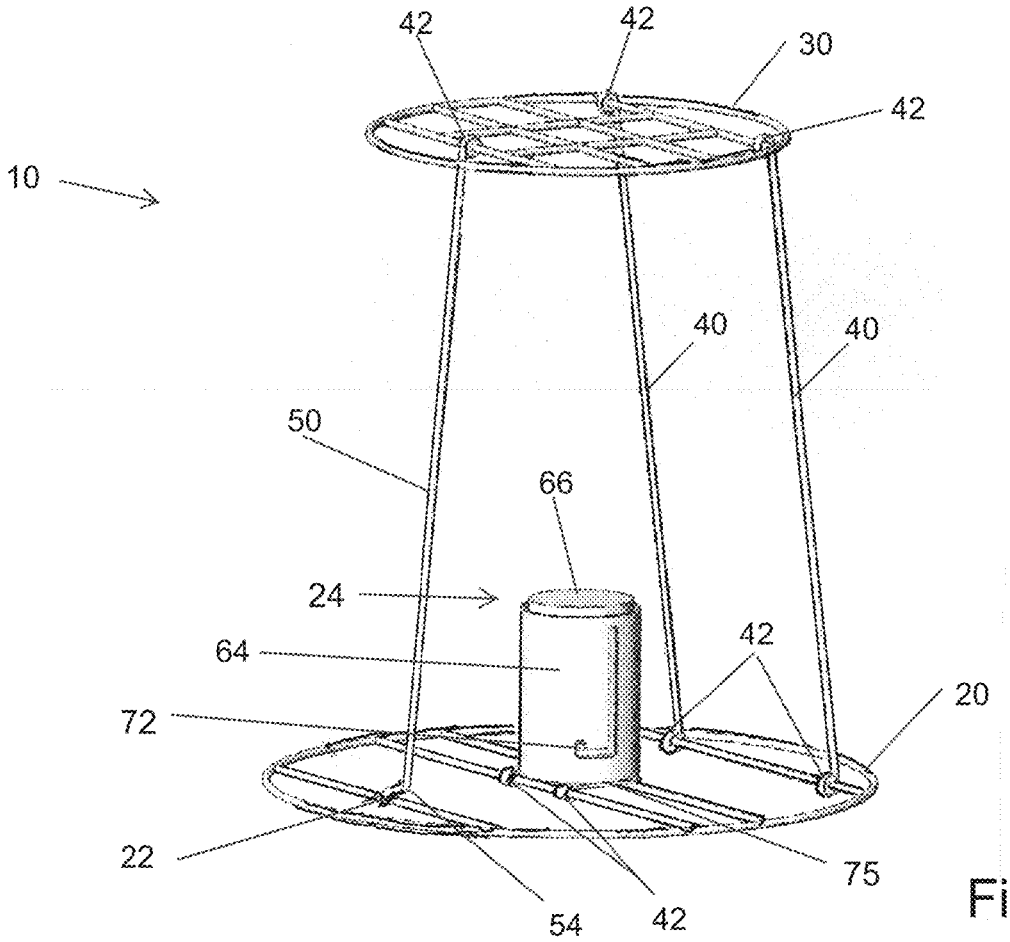
FIG. 4 is a perspective view of further embodiments thereof.

Disclosed in FIGS. 1-5 are embodiments of a folding illumination stand which shall be referred to herein by the term "stand 10." FIG. 1 shows embodiments of stand 10 wherein structural parts may be constructed of heavy gage steel wire, e.g., 3/16 inch. round, by welding or other joining means. When unfolded and standing upright stand 10 may be between 11 and 12 inches tall and when folded it may be about 2.3 inches in height. Stand 10 may include a pair of flat wire discs 20 and 30 and at least two wire legs 40 joined by rotational couplings 42 at opposing ends thereof to both wire discs 20 and 30 wherein wire disc 30 may be positioned above wire disc 20. Stand 10 may further have at least one further wire leg 50 which may be rotationally joined at one end 52 to wire disc 20 and may be engaged at a further end 54 with wire disc 30 but removable for reasons to be described. In FIG. 4 it is shown that further end 54 of wire leg 50 may be removably joined to wire disc 20 rather than disc 30. Further end 54 may have an offset terminal portion 56 which may be inserted into an eyelet 22 said eyelet welded to wire disc 30 in FIG. 1 and shown also at wire disk 20 in FIG. 4. Rotational couplings 42 may be small bushings or may be simple circular bends at terminal ends of legs 40 and 50. As shown wire legs are joined to cross-wires of discs 20 and 30 and are rigid enough to support a load placed on wire disc 30.

Figure 5:
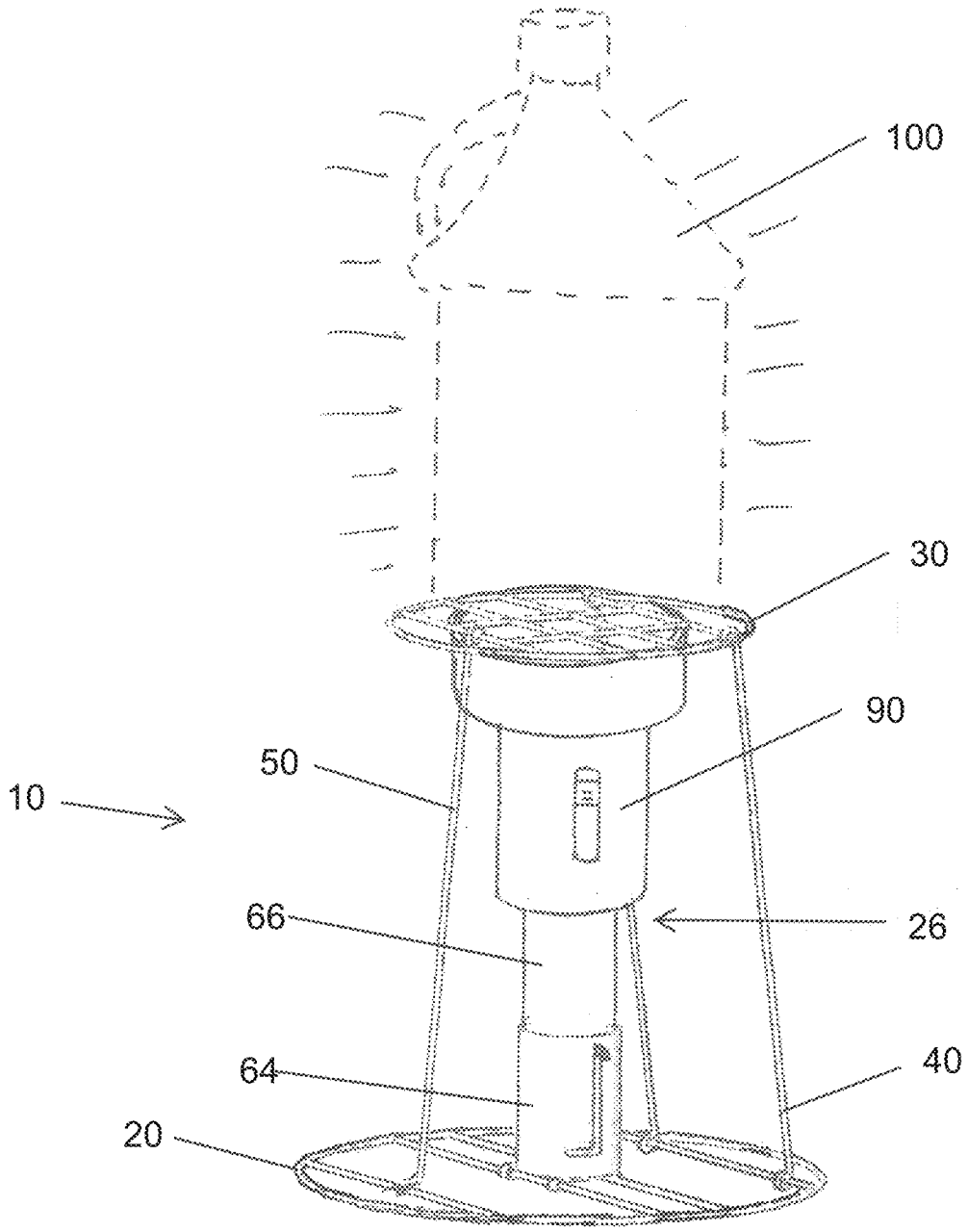
FIG. 5 is a perspective view of further embodiments in combination with a flashlight and a translucent vessel.

A linear extender 60 (the term used herein to refer to a device that has the ability to extend linearly) may be joined to wire disc 20 by engagement loops 62 as shown in FIG. 2, or by other means, and may be extendable from a compressed state shown in FIGS. 3 and 4, to an extended state shown in FIGS. 1 and 2; that is, between a proximal position 24 shown in FIG. 4 and a selected distal position 26 shown in FIG. 5. In embodiments shown in FIG. 1, extender 60 may be formed as a lower cup 64 fixed to wire disc 20 as said, and an upper cup 66, wherein cups 64 and 66 may be fixed at opposing ends of a coil spring 68 wherein this attachment may be by any mechanical means which will be known to those of skill in the art. As also shown in FIG. 1, lower cup 64 may have a pair of opposing engagement slots 70 and such slots may be L-shaped as shown, and upper cup 66 may have a pair of corresponding outwardly extending opposing ears 72 one of which is shown in FIG. 1 while an opposing ear 72 is hidden in the figure. Upper cup 66 may be of such size as to fit within lower cup 64 upon compressing spring 68 which may be a conical type spring so that each smaller spring turn fits within a previous next larger spring turn, wherein spring 68 is able to be compressed into a relatively small vertical space within cups 64 and 66 as shown in FIGS. 3 and 4. In an embodiment which is not shown but which would be quickly realized by one of skill in the art when exposed to the previous embodiment, cup 66 may be slightly larger than cup 64 and said L-shaped slots 70 may be formed in the side wall of upper cup 66 while opposing ears 72 may extend from lower cup 64. In either embodiment, when ears 72 are fully engaged with L-shaped slots 70 upper cup 66 may be rotated by up to 10 degrees clockwise to secure engagement of ears 72 with horizontal portions of slots 70 to thereby achieve a stable highly compact storage arrangement of extender 60. An upwardly extending high friction rim or flange 74 may be engaged with or formed on top of upper cup 66 so as to improve clamping action as will be described.

The embodiments of FIG. 3 show that when folded, stand 10 is able to assume a relatively compact format of its elements. The requires disengaging offset terminal portion 56 of wire leg 50 from eyelet 22 and rotating leg 50 by 270 degrees using slot 80 for clearance.

The embodiments of FIG. 4 illustrate that cups 64 and 66 may be extensive in the vertical direction and may be mutually engaged in a telescoping arrangement which may completely contain spring 68 so as to prevent any lateral movement of spring 68. Of course this means that when mutually fully engaged cups 64 and 66 take up an undesirable greater vertical space. This may be partially avoided by mounting cups 64 and 66 on hinged platform 75 so that said cups 64 and 66 and platform 75 may be rotated by 90 degrees to present a more compact thickness when folded.

In FIG. 5 extender 60 is shown extended vertically to an extent where it is able to clamp a flashlight 90 between cup 66 or rim/flange 74 and the bottom surface of wire disk 30. A translucent water bottle or jug 100 is shown in outline with dash lines wherein jug 100 is supported by the top surface of wire disk 30 which functions as a support platform. Lines are shown extending from jug 100 to represent illumination given off by the walls of jug 100. In this arrangement, a light beam projected from flashlight 90 passes through wire disk 30 and enters jug 100 through its bottom wall. The flashlight beam illuminates jug 100 which glows like an incandescent lamp thereby projecting light in all directions to provide a comfortable warm illumination for a camp site or within a tent.

In the foregoing description, embodiments are described as a plurality of individual parts, and this is solely for the sake of illustration. Accordingly, it is contemplated that some additional parts may be added, some parts may be changed or omitted, and the order of the parts may be re-arranged, without leaving the sense and understanding of the apparatus as claimed.

What is claimed is:

1. A folding illumination stand having an upright unfolded attitude comprising:

a pair of mutually parallel and spaced apart flat discs of wire construction;

said flat discs joined together by at least three wire legs;

a linear extender fixed to one of said flat discs and extendable toward the other of said flat discs;

said linear extender having a means for urging extension and a means for inhibiting said extension;

wherein said linear extender is rotationally fixed to said one of said flat discs.

2. The folding illumination stand of claim 1 wherein one end of at least one of said wire legs is removably joined with one of said flat discs thereby enabling said folding illumination stand to assume a folded flat attitude.

3. The folding illumination stand of claim 1 wherein said urging means is a compressible conical coil spring.

4. The folding illumination stand of claim 1 wherein said flat discs are circular.

5. The folding illumination stand of claim 1 wherein said inhibiting means is an ear in slot arrangement.

6. The folding illumination stand of claim 5 wherein said ear in slot arrangement has L-shaped slots.

7. The folding illumination stand of claim 3 wherein a flashlight is wedged by said conical coil spring between said linear extender and one of said flat discs.

8. The folding illumination stand of claim 7 wherein said one of said flat discs is sandwiched between said flashlight and a translucent vessel wherein a light beam from said flashlight is directed into said vessel.

* * * * *